US008580473B2

(12) United States Patent
Ariyoshi et al.

(10) Patent No.: US 8,580,473 B2
(45) Date of Patent: Nov. 12, 2013

(54) TONER AND METHOD FOR MANUFACTURING THE SAME

(75) Inventors: Satoru Ariyoshi, Osaka (JP); Yasuhiro Shibai, Osaka (JP); Nobuhiro Maezawa, Osaka (JP); Katsuru Matsumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 203 days.

(21) Appl. No.: 13/157,060

(22) Filed: Jun. 9, 2011

(65) Prior Publication Data

US 2011/0305988 A1 Dec. 15, 2011

(30) Foreign Application Priority Data

Jun. 11, 2010 (JP) ..... P2010-134594

(51) Int. Cl.
*G03G 9/087* (2006.01)

(52) U.S. Cl.
USPC ..... 430/109.4; 430/137.2

(58) Field of Classification Search
USPC ..... 430/109.4, 137.2, 137.18
See application file for complete search history.

(56) References Cited

U.S. PATENT DOCUMENTS

| | | | |
|---|---|---|---|
| 2003/0203301 | A1 | 10/2003 | Iga |
| 2005/0147911 | A1 | 7/2005 | Shirai et al. |
| 2010/0068644 | A1 | 3/2010 | Nakajima et al. |
| 2011/0123922 | A1 | 5/2011 | Yamane et al. |
| 2011/0305982 | A1 | 12/2011 | Matsumoto et al. |
| 2011/0305985 | A1 | 12/2011 | Ariyoshi et al. |

FOREIGN PATENT DOCUMENTS

| | | | |
|---|---|---|---|
| JP | 2003-322997 | | 11/2003 |
| JP | 2005-195805 | | 7/2005 |
| JP | 2007-293327 | | 11/2007 |
| JP | 2008-122509 | | 5/2008 |
| JP | 2008-310284 | | 12/2008 |
| JP | 2010-20170 | | 1/2010 |
| JP | 2010-66641 | | 3/2010 |
| JP | 2010-107678 | | 5/2010 |
| JP | 2011-013353 | A1 * | 1/2011 |
| WO | WO 2010-004826 | A1 * | 1/2010 |

OTHER PUBLICATIONS

AIPN Japanese Patent Office machine-assisted translation of JP 2011-013353 (pub. Jan. 2011).*

* cited by examiner

*Primary Examiner* — Janis L Dote
(74) *Attorney, Agent, or Firm* — Nixon & Vanderhye P.C.

(57) ABSTRACT

A toner includes a binder resin and a colorant. The binder resin contains a polyester resin A obtained by subjecting aromatic dicarboxylic acid, rosin, and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation, the polyester resin B having a viscosity of $10^3$ Pa·s or more and $10^5$ Pa·s or less at a softening temperature of the polyester resin A, the polyester resin B being contained in an amount of 50 parts by weight or more and 200 parts by weight or less relative to 100 parts by weight of the polyester resin A.

2 Claims, 1 Drawing Sheet

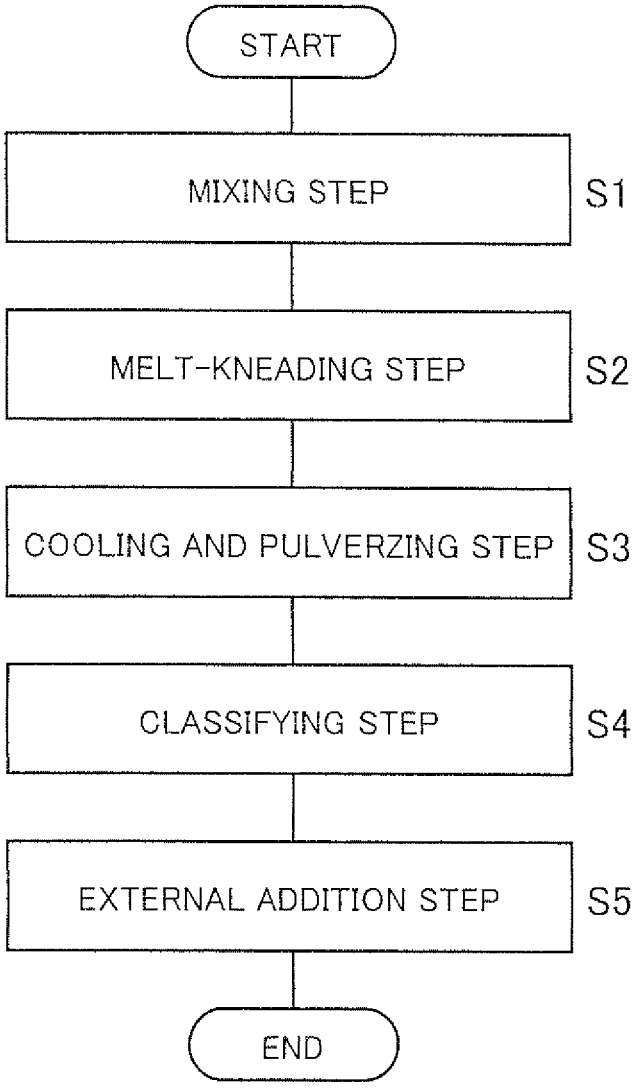
START
MIXING STEP
S1
MELT-KNEADING STEP
S2
COOLING AND PULVERZING STEP
S3
CLASSIFYING STEP
S4
EXTERNAL ADDITION STEP
S5
END

TONER AND METHOD FOR MANUFACTURING THE SAME

CROSS-REFERENCE TO RELATED APPLICATION

This application claims priority to Japanese Patent Application No. 2010-134594, which was filed on Jun. 11, 2010, the content of which is incorporated herein by reference in its entirety.

BACKGROUND OF THE TECHNOLOGY

1. Field of the Technology

The present technology relates to a toner and a method for manufacturing the same.

2. Description of the Related Art

Toners for visualizing latent images are used in various image forming processes and for example, are used in an electrophotographic image forming process.

Image forming apparatuses employing the electrophotographic image forming process generally execute a charging step of uniformly charging a photosensitive layer on the surface of a photoreceptor drum serving as a latent image bearing member, an exposure step of projecting signal light of an original image on the surface of the photoreceptor drum that is being charged to form an electrostatic latent image, a development step of visualizing the electrostatic latent image on the surface of the photoreceptor drum by supplying an electrophotographic toner thereto, a transfer step of transferring a toner image on the surface of the photoreceptor drum to a recording medium such as paper and OHP sheets, a fixing step of fixing the toner image onto the recording medium under heat, pressure and the like, and a cleaning step of eliminating the toner and the like remaining on the surface of the photoreceptor drum after the toner image is transferred, with a cleaning blade for cleaning, to form a desired image on the recording medium. Transfer of a toner image to a recording medium may be performed through an intermediate transfer medium.

The electrophotographic toner for use in such image formation is manufactured, for example, by a knead-pulverization method, a polymerization method represented by a suspension polymerization method, an emulsification polymerization method and the like. Among them, in the knead-pulverization method, the toner is manufactured in such a manner that toner materials including a binder resin and a colorant as main components, to which a release agent, a charge control agent and the like are added as necessary and mixed, are melt-kneaded, cooled and solidified, then subjected to pulverization and classification.

In recent years, numerous efforts have been made in various technical fields from a viewpoint of global environmental protection. Today, oil is used as materials of many products, and energy is necessary for manufacturing and burning such materials, and carbon dioxide is generated. Efforts for reducing such energy and carbon dioxide are very important as global warming countermeasures.

For new efforts for reducing carbon dioxide as global warming countermeasures, much attention has been focused on the use of a plant-derived resource called biomass. Because the carbon dioxide generated in burning the biomass originates from the carbon dioxide which was present in the atmosphere and was taken in a plant through photosynthesis, the whole balance of input and output amounts of the carbon dioxide in the atmosphere is zero. In this manner, the property which does not affect an increase and a decrease in the carbon dioxide in the atmosphere is called carbon-neutral, and the use of the biomass having the carbon-neutral property is not considered to increase the amount of the carbon dioxide in the atmosphere. The biomass material made from such biomass is called by terms, such as a biomass polymer, a biomass plastic, or an oil-free polymer material, and the material of such biomass material is a monomer called a biomass monomer.

Also in the electrophotographic field there have been made many efforts to use the biomass which is a resource excellent in environmental safety and effective for suppressing increase in the carbon dioxide.

In addition, Japanese Unexamined Patent Publication JP-A 2008-122509 discloses a resin composition for an electrophotographic toner which contains a polyester resin having a softening temperature of 80 to 120° C. which is obtained from rosin as an essential component, and a polyester resin having a softening temperature of 160° C. or higher which is obtained from a polyepoxy compound as an essential component, and has low-temperature fixability, hot-offset resistance and development durability.

However, in the toner manufactured by the method disclosed in JP-A 2008-122509, when a rosin content in the resin composition is increased in order to enhance utilization rate of biomass, the toner becomes fragile. When such a toner is used as a developer, stress due to agitating in a development tank or the like causes a problem that the toner is crushed and fine powder is generated so that the charge amount is not stabilized, and that elasticity of the toner is decreased and hot offset easily occurs.

SUMMARY OF THE TECHNOLOGY

An object of the technology is to provide a toner which has a high content of rosin serving as biomass, and is excellent in hot-offset resistance and charging stability.

Further, an object of the technology is to provide a method for manufacturing a toner which has a high content of rosin serving as biomass, and is excellent in hot-offset resistance and charging stability.

The technology provides a toner comprising:

a binder resin containing a polyester resin A obtained by subjecting aromatic dicarboxylic acid, rosin, and trivalent or higher-valent alcohol as starting materials to polycondensation, a content of the rosin in a sum of starting materials being 60% by weight or more, and a polyester resin B obtained by subjecting aromatic dicarboxylic acid and polyhydric alcohol as starting materials to polycondensation, the polyester resin B having a viscosity of $10^3$ Pa·s or more and $10^5$ Pa·s or less at a softening temperature of the polyester resin A, the polyester resin B being contained in an amount of 50 parts by weight or more and 200 parts by weight or less relative to 100 parts by weight of the polyester resin A; and a colorant.

A toner comprises a binder resin and a colorant. In the toner, the binder resin has a polyester resin A obtained by subjecting aromatic dicarboxylic acid, rosin, and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation, the polyester resin B having a viscosity of $10^3$ Pa·s or more and $10^5$ Pa·s or less at a softening temperature of the polyester resin A, the polyester resin B being contained in an amount of 50 parts by weight or more and 200 parts by weight or less relative to 100 parts by weight of the polyester resin A. A toner having excellent preservation stability is thus obtained. Moreover, it is possible to form the toner sufficient in mechanical strength as well as excellent in a hot-offset resistance and charging stability.

It is preferable that the toner is formed of an admixture of a master batch which contains the polyester resin A and the colorant, and the polyester resin B.

The technology provides a method for manufacturing a toner, comprising:

a mixing step of preparing an admixture by mixing a binder resin and a colorant, the binder resin containing a polyester resin A obtained by subjecting aromatic dicarboxylic acid, rosin, and trivalent or higher-valent alcohol as starting materials to polycondensation, content of the rosin in a sum of the starting materials being 60% by weight or more, and a polyester resin B obtained by subjecting aromatic dicarboxylic acid and polyhydric alcohol as starting materials to polycondensation, the polyester resin B having a viscosity of $10^3$ Pa·s or more and $10^5$ Pa·s or less at a softening temperature of the polyester resin A, the polyester resin B being contained in an amount of 50 parts by weight or more and 200 parts by weight or less relative to 100 parts by weight of the polyester resin A;

a melt-kneading step of melt-kneading the admixture to prepare a kneaded material;

a cooling and pulverizing step of cooling, solidifying and pulverizing the kneaded material prepare a pulverized material; and a classifying step of classifying the pulverized material.

A method for manufacturing a toner comprises a mixing step, a melt-kneading step, a cooling and pulverizing step and classifying step. At the mixing step, an admixture is prepared by mixing a binder resin and a colorant, the binder resin containing a polyester resin A obtained by subjecting aromatic dicarboxylic acid, rosin, and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation, the polyester resin having a viscosity of $10^3$ Pa·s or more and $10^5$ Pa·s or less in a softening temperature of the polyester resin A, the polyester resin B being contained in an amount of 50 parts by weight or more and 200 parts by weight or less relative to 100 parts by weight of the polyester resin A. At the melt-kneading step, the admixture is melt-kneaded to prepare a kneaded material. At the cooling and pulverizing step, the kneaded material is cooled, solidified and pulverized to prepare a pulverized material. At the classifying step, the pulverized material is classified. Thereby; a toner whose mechanical strength is sufficient and which is excellent in a hot-offset resistance and charging stability can be obtained.

Further, it is preferable that the mixing step comprises:

preparing a master batch by mixing and kneading the polyester resin A and the colorant; and preparing the admixture by mixing the polyester resin B and the master batch.

Further, the mixing step comprises preparing a master batch by mixing and kneading the polyester resin A and the colorant, and preparing the admixture by mixing the polyester resin B and the master batch. Therefore, the colorant can be dispersed into the resin uniformly so that a uniform toner can be obtained.

BRIEF DESCRIPTION OF THE DRAWINGS

Other and further objects, features, and advantages of the technology will be more explicit from the following detailed description taken with reference to the drawings wherein:

FIG. 1 is a flowchart showing an example of procedure of a method for manufacturing a toner according to an embodiment.

DETAILED DESCRIPTION

Now referring to the drawings, preferred embodiments are described below.

1. Method for Manufacturing Toner

FIG. 1 is a flowchart showing an example of procedure of a method for manufacturing a toner according to an embodiment. A toner according to the embodiment includes a binder resin and a colorant as main components and is manufactured by the method for manufacturing the toner according to the embodiment. The method for manufacturing the toner according to the embodiment is a method for forming particles by dry process and includes a mixing step S1, a melt-kneading step S2, a cooling and pulverizing step S3, a classifying step S4, and an external addition step S5.

(1) Mixing Step S1

At the mixing step S1, a binder resin and a colorant are dry-mixed with each other in a mixer to prepare an admixture. At this time, an additive is added as necessary. Examples of the additive include magnetic powder, a release agent, and a charge control agent.

(Binder Resin)

The toner according to the embodiment contains two kinds of polyester resins A and B as the binder resin. The polyester resin can provide excellent transparency and imparts excellent powder flowability, low-temperature fixability, secondary color reproducibility and the like to toner particles and is therefore suitable for a material for a color toner. Polyester is obtained by means of polycondensation of acid components such as polybasic acid and polyalcohol.

The polyester resins A and B according to the embodiment are manufactured by a publicly known polycondensation reaction method. As a reaction method, ester exchange reaction or direct esterification reaction is applicable. Moreover, it is also possible to prompt polycondensation such as by increasing a reaction temperature under pressure, or flowing inactive gases under reduced pressure or normal pressure. In the aforementioned reaction, the reaction may be prompted using a publicly known and common reaction catalyst such as at least one of metal compounds among antimony, titanium, tin, zinc, aluminum, and manganese. The amount of the reaction catalyst added is preferably 0.01 part by weight or more and 1.0 part by weight or less relative to 100 parts by weight of the sum of acid components and polyalcohol.

In preparing the polyester resin A, aromatic dicarboxylic acid and rosin are used as acid components, and trivalent or higher-valent alcohol is used as polyalcohol. With the reaction of the aromatic dicarboxylic acid and the trivalent or higher-valent alcohol, a polyol structure with an appropriate branch is formed. When the polyester resin includes an appropriate branched structure, it is possible to maintain low-temperature fixability of the toner without extremely increasing a softening temperature of the resin as well as to broaden a molecular weight distribution of the resin and to obtain a resin in which a distribution of the high-molecular weight side is broad, so that the toner has an excellent offset resistance.

Examples of the aromatic dicarboxylic acid used for the polyester resin A include phthalic acid, terephthalic acid, isophthalic acid, biphenyldicarboxylic acid, naphthalenedicarboxylic acid, and 5-tert-butyl-1,3-benzenedicarboxylic acid. In addition, as the acid components of the polyester resin A, instead of the aforementioned aromatic dicarboxylic acids, aromatic dicarboxylic acid anhydride or an aromatic dicarboxylic acid derivative such as lower alkyl ester may be used. Among the aforementioned aromatic dicarboxylic acid compounds, at least one of terephthalic acid, isophthalic acid, and lower alkyl esters thereof is preferably used. The aforementioned aromatic dicarboxylic acid compounds have a great electron resonance stabilization effect by the aromatic ring skeleton and excellent charging stability, thereby obtaining a resin with appropriate strength. Examples of the lower alkyl ester of terephthalic acid and isophthalic acid include dimethyl terephthalate, dimethyl isophthalate, diethyl terephthalate, diethyl isophthalate, dibutyl terephthalate, and dibutyl isophthalate. Among them, dimethyl terephthalate or dimethyl isophthalate is preferably used from a viewpoint of cost and handling.

These aromatic dicarboxylic acid compounds may be used each alone, or two or more of them may be used in combination.

Examples of the trivalent or higher-valent alcohol used for the polyester resin A include trimethylolethane, trimethylolpropane, glycerin, and pentaerythritol, and at least one of these polyalcohols is usable. Among them, glycerin is more preferable because a technique of manufacturing from a plant-derived material is established industrially so that glycerin is easily available and an effect of prompting the use of biomass is obtained.

A mole ratio of the trivalent or higher-valent alcohol to the aromatic dicarboxylic acid compound in the polyester resin A is preferably 1.05 or more and 1.65 or less. When the mole ratio of the trivalent or higher-valent alcohol to the aromatic dicarboxylic acid compound is less than 1.05, a molecular weight distribution of the high-molecular weight side of the resin is broadened and Tm becomes high to thereby decrease low-temperature fixability of the toner, and it becomes impossible to control broadening of the molecular weight distribution, resulting that gelation of the toner occurs. When the mole ratio exceeds 1.65, the polyester resin has less branched structures and a softening temperature and a glass transition temperature are thus reduced, resulting that preservation stability of the toner is decreased.

The rosin used for the polyester resin A is preferably disproportionated rosin. The disproportionated rosin is obtained by stabilizing rosin which is a natural resin obtained from pine with disproportionation reaction. The rosin contains as main components resin acids such as abietic acid, palustric acid, neoabietic acid, pimaric acid, dehydroabietic acid, isopimaric acid and sandaracopimaric acid, and an admixture thereof, and is classified into toll rosin obtained from a crude toll oil which is a by-product in the production process of pulp, gum rosin obtained from raw turpentine, wood rosin obtained from stumps of pine trees, and the like. These rosins are obtained by a conventionally known method.

The disproportionated rosin is obtained in such a manner that rosin is heated at a high temperature in the presence of noble metal catalyst or halogen catalyst, and is polycondensed cyclic monocarboxylic acid in which an unstable conjugate double bond in a molecule disappears, which has a feature that a material is hard to be converted compared to rosin having a conjugate double bond. The disproportionated rosin contains a mixture of dehydroabietic acid and dihydroabietic acid as main components. Since the disproportionated rosin includes a bulky and rigid skeleton of hydrophenanthrene ring, by introducing the disproportionated rosin as components of polyester, a pulverization property in manufacturing the toner is improved, thus making it possible to obtain a toner having excellent preservation stability with little decrease of a glass transition temperature.

As describe above, the polyester resin A is obtained by subjecting aromatic dicarboxylic acid, rosin, and trivalent or higher-valent alcohol as starting materials to polycondensation. In the embodiment, for obtaining a toner with excellent environmental safety, the rosin content in the starting materials is not less than 60% by weight as the underlying structure of the polyester resin A.

For the polyester resin A, aliphatic polycarboxylic acid or trivalent or higher-valent aromatic polycarboxylic acid is further usable as the acid component other than the aforementioned aromatic dicarboxylic acid compounds and rosin.

Examples of the aliphatic polycarboxylic acid include alkyl dicarboxylic acids such as succinic acid, adipic acid, sebacic acid, and azelaic acid; unsaturated dicarboxylic acids such as succinic acid which is substituted by an alkyl group having a carbon number of 16 to 18, fumaric acid, maleic acid, citraconic acid, itaconic acid, and glutaconic acid; and dimmer acid.

The content of the aliphatic polycarboxylic acid in the polyester resin A is preferably 0.5 mole or more and 15 moles or less, and more preferably 1 mole or more and 13 moles or less relative to 100 moles of the aromatic dicarboxylic acid compound. When the content of the aliphatic polycarboxylic acid in the polyester resin A falls within such a range, low-temperature fixability of the toner is improved.

Examples of the trivalent or higher-valent aromatic polycarboxylic acid include trimellitic acid, pyromellitic acid, naphthalenetricarboxylic acid, benzophenonetetracarboxylic acid, biphenyltetracarboxylic acid, and anhydride thereof. These aromatic polycarboxylic acids may be used each alone, or two or more of them may be used in combination. Among these aromatic polycarboxylic acids, anhydrous trimellitic acid is preferably used from a viewpoint of reactivity.

A content of the trivalent or higher-valent aromatic polycarboxylic acid in the polyester resin A is preferably 0.1 mole or more and 5 moles or less, and more preferably 0.5 mole or more and 3 moles or less relative to 100 moles of the aromatic dicarboxylic acid compound. When the content of the trivalent or higher-valent aromatic polycarboxylic acid in the polyester resin A is less than 0.1 mole, the branched structure included in the polyester resin is insufficient and it is impossible to obtain a resin in which a molecular weight distribution of the high-molecular weight side is broad, so that an offset resistance of the toner is decreased. Moreover, in the case of exceeding 5 moles, a softening temperature of the resin becomes high so that low-temperature fixability of the toner is decreased.

In addition, for the polyester resin A, at least one of aliphatic diol and etherified diphenol is further usable as the polyalcohol other than the trivalent or higher-valent alcohol.

Examples of the aliphatic dial include ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glycol, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol, 1,10-decanediol, 3-hydroxy-2,2-dimethylpropyl-3-hydroxy-2,2-dimethylpropanoate, diethylene glycol, triethylene glycol, and dipropylene glycol. Among these aliphatic diols, ethylene glycol, 1,3-propanediol, or neopentyl glycol is preferably used from a viewpoint of reactivity with acid and a glass transition temperature of the resin. These aliphatic dials may be used each alone, or two or more of them may be used in combination.

Generally, the content of the aliphatic diol in the polyester resin A is preferably 5 moles or more and 20 moles or less relative to 100 moles of the aromatic dicarboxylic acid compound.

The etherified diphenol is dial obtained by subjecting bisphenol A and alkylene oxide to addition reaction. Examples of the alkylene oxide include ethylene oxide and propylene oxide, and the alkylene oxide is preferably added so that the average mole number is 2 moles or more and 16 moles or less relative to 1 mole of the bisphenol A.

Generally, the content of the etherified diphenol in the polyester resin A is preferably 5 moles or more and 35 moles or less relative to 100 moles of the aromatic dicarboxylic acid compound.

In the toner according to the embodiment, the content of the polyester resin A is preferably 20 parts by weight or more and 60 parts by weight or less relative to 100 parts by weight of the toner. When the content of the polyester resin A is less than 20 parts by weight, the viscosity of the toner increases to diminish low-temperature fixability. In addition, when the content of the polyester resin A exceeds 60 parts by weight, the content of the rosin is increased so that the mechanical strength of the toner is decreased or powder flowability is decreased.

The polyester resin B is a polyester resin which substantially does not include rosin, and preferably has high-molecular weight and high viscosity to impart a high-temperature offset resistance to the toner As the acid component of the polyester resin B, the aromatic dicarboxylic acid compound similar to that of the polyester resin A is usable. The polyester resin A and the polyester resin. B may include the same or different aromatic dicarboxylic acid compound. In addition, for the polyester resin B, as the acid component, aliphatic polycarboxylic acid or trivalent or higher-valent aromatic polycarboxylic acid similar to that of the polyester resin A is further usable other than the aforementioned aromatic dicarboxylic acid compound. The polyester resin A and the polyester resin B may use the same or different acid component.

Moreover, as the acid component of the polyester resin B, polybasic acids such as saturated polybasic acid and unsaturated polybasic acid, acid anhydride thereof, and lower alkyl ester thereof are usable.

Examples of the saturated polybasic acid, the saturated polybasic acid anhydride, and lower alkyl ester thereof include dibasic acids such as adipic acid, sebacic acid, orthophthalic acid, phthalic anhydride, isophthalic acid, terephthaiic acid, succinic acid, succinic anhydride, alkyl succinic acid having a carbon number of 8 to 18, alkyl succinic anhydride, alkenyl succinic acid, and alkenyl succinic anhydride; trimellitic acid; trimellitic anhydride; cyanuric acid; pyromellitic acid; and pyromellitic anhydride.

Examples of the unsaturated polybasic acid include maleic acid, maleic anhydride, and fumaric acid.

Polybasic acids such as the saturated polybasic acid and the unsaturated polybasic acid, the acid anhydride thereof, and the lower alkyl ester thereof may be used each alone, or two or more of them may be used in combination. In addition, monobasic acids such as benzonic acid and p-tert-butyl benzonic acid may be used as necessary.

As the polyalcohol of the polyester resin B, trivalent or higher-valent alcohol, aliphatic dial, and etherified diphenol are usable similarly to those of the polyester resin A, and the polyester resin B may use the same or different polyalcohol as or from that of the polyester resin A. Moreover, alicyclic dials such as cyclohexanedimethanol may be used. The polyalcohols may be used each alone, or two or more of them may be used in combination. Further, monoalcohols such as stearyl alcohol may be used as necessary to an extent that the effect of the technology is not impaired.

A viscosity of the polyester resin B is $10^3$ Pa·s or more and $10^5$ Pa·s or less at a softening temperature of the polyester resin A. When the viscosity of the polyester resin B at the softening temperature of the polyester resin A is less than $10^3$ Pa·s, a hot-offset resistance of a toner cannot be obtained. Moreover, when the viscosity of the polyester resin B at the softening temperature of the polyester resin A exceeds $10^5$ Pa·s, there is great difference of melt viscosity between the polyester resin A and the polyester resin B at the time of kneading, and mixability of resins becomes worse, so that the polyester resin A and the polyester resin B in the toner come to have uneven dispersibility. In a toner particle, a part with a high rate of the presence of the polyester resin A is easily broken, and such breakage causes occurrence of fine powder with a small particle size. With such fine powder, particle size distribution and charging distribution are broadened, resulting that failure such as an image fog is caused.

A content of the polyester resin B is 50 parts by weight or more and 200 parts by weight or less relative to 100 parts by weight of the polyester resin A. When the content of the polyester resin B is less than 50 parts by weight relative to 100 parts by weight of the polyester resin A, the strength of the toner becomes insufficient so that breakage thereof with mechanical stress generates fine powder whose particle size is small, which causes the failure as described above. Moreover, in the case of exceeding 200 parts by weight, the viscosity of the admixture at the time of kneading becomes high and mixability of the resins deteriorates, so that the failures as described above occur.

The glass transition temperature of the polyester resins A and B used in the embodiment is not particularly limited and may be selected appropriately from a wide range, and taking into account preservation stability and low-temperature fixability of the obtained toner, the glass transition temperature is preferably 45° C. or higher and 80° C. or lower, and more preferably 50° C. or higher and 65° C. or lower. When the glass transition temperature of the polyester resins A and B is lower than 45° C., the preservation stability is insufficient so that thermal aggregation of the toner in the inside of an image forming apparatus is easy to occur, thus generating development failure. Moreover, a temperature at which the generation of hot offset starts (hereinafter referred to as "hot offset initiation temperature") is lowered. The "hot offset" refers to a phenomenon in which in fixing a toner onto a recording medium by heating and applying a pressure with a fixing member, an aggregation power of heated toner particles is lower than an adhesive strength between the toner and the fixing member, so that the toner layer is divided and a part of the toner attaches to the fixing member and is removed away. In addition, when the glass transition temperature of the polyester resins A and B exceeds 80° C., low-temperature fixability of the toner is decreased, thereby generating fixing failure.

For the binder resin of the toner according to the embodiment, as long as it is possible to achieve the object of the technology, resins which are conventionally used as the binder resin for a toner, including a polystyrene-based polymer, a polystyrene-based copolymer such as a styrene-acryl-based resin, and polyester resins other than the aforementioned polyester resins, may be used with the aforementioned polyester resins.

(Colorant)

As a colorant included in the toner according to the embodiment, those which are commonly used in the electrophotographic field such as an organic dye, an organic pigment, an inorganic dye, and an inorganic pigment are usable. Among a dye and a pigment, a pigment is preferably used. Since a pigment is more excellent in light resistance and coloring properties than a dye, the use of a pigment makes it possible to obtain a toner having excellent light resistance and coloring properties.

Examples of a yellow colorant include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180, and C.I. Pigment Yellow 185; inorganic pigments such as yellow iron oxide and yellow ocher; nitro-based dyes such as C.I. Acid Yellow 1; and oil-soluble dyes such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21, which are all classified according to color index.

Examples of a red colorant include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10, and C.I. Disperse Red 15, which are all classified according to color index.

Examples of a blue colorant include C.I. Pigment Blue 15, C.I. Pigment Blue 16, C.I. Solvent Blue 55, C.I. Solvent Blue 70, C.I. Direct Blue 25, and C.I. Direct Blue 86, which are all classified according to color index, and KET. BLUE 111.

Examples of a black colorant include carbon black such as channel black, roller black, disk black, gas furnace black, oil furnace black, thermal black, and acetylene black.

Other than these colorants, a bright red pigment, a green pigment, and the like are usable. These colorants may be used each alone, or two or more of them may be used in combination. Further, it is possible to use two or more of the colorants of the same color series and also possible to use one or two or more of the colorants respectively from different color series.

The colorant is preferably used in form of a master batch in order to be dispersed uniformly into the polyester resin. In the embodiment, the master batch can be manufactured, for example, by dry-mixing the polyester resin A and the colorant in a mixer and kneading the obtained powder admixture by a kneader. A kneading temperature depends on the softening temperature of the polyester resin A and is generally about 50 to 150° C. and preferably about 50 to 120° C.

For the mixer for dry-mixing master batch materials, publicly known mixers are usable and examples thereof include a Henschel-type mixing device such as HENSCHEL MIXER (trade name, manufactured by Mitsui Mining Co., Ltd.), SUPERMIXER (trade name, manufactured by Kawata MEG Co., Ltd.), and MECHANOMILL (trade name, manufactured by Okada Seiko Co., Ltd.); ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries, Ltd.) Also for the kneader, publicly known kneaders are usable and, for example, general kneaders such as a kneader, a twin-screw extruder, a two-roller mill, a three-roller mill, and a laboplast mill are usable. More specifically, examples thereof include single-screw or twin-screw extruders such as TEM-100B (trade name, manufactured by Toshiba Machine Co., Ltd.), and PCM-65/87 or PCM-30 (all of which are a trade name, manufactured by Ikegai Corp), and open roll type kneaders such as KNEADEX (trade name, manufactured by Mitsui Mining Co., Ltd.) Melt-kneading may be performed with the use of a plurality of kneaders.

The obtained master batch is, for example, pulverized into a particle size of from about 2 mm to 3 mm and then used.

As the concentration of the colorant in the toner, the concentration of the black colorant such as carbon black is preferably 5% by weight or more and 12% by weight or less, and more preferably 6% by weight or more and 8% by weight or less. The concentration of the colorant other than black is preferably 3% by weight or more and 8% by weight or less, and more preferably 4% by weight or more and 6% by weight or less. When the master batch is used, it is preferred to adjust the used amount of the master batch so that the concentration of the colorant in the toner falls within such a range. When the concentration of the colorant falls within such a range, it is possible to obtain a toner that suppresses the filler effect caused by addition of the colorant and has high color appearance and is also possible to form a good image having sufficient image density, a high coloring property and favorable image quality.

(Magnetic Powder)

Examples of the magnetic powders included in the toner according to the embodiment include magnetite, γ-hematite, and various kinds of ferrite.

(Release Agent)

As the release agent included in the toner according to the embodiment, those which are commonly used in this field are usable and an example thereof includes a wax. Examples of the wax include natural waxes such as a paraffin wax, a carnauba wax, and a rice wax; synthetic waxes such as a polypropylene wax, a polyethylene wax, and a Fischer-Tropsch wax; coal based waxes such as a montan wax; petroleum based waxes; alcohol based waxes; and ester based waxes.

The release agents may be used each alone, or two or more of them may be used in combination. The amount of the release agent added is not particularly limited and may be selected appropriately from a wide range depending upon various conditions such as the kinds and contents of other components including the binder resin and the colorant or properties which are required for the toner to be prepared, and is preferably 3 parts by weight or more and 10 parts by weight or less relative to 100 parts by weight of the binder resin. When the amount of the release agent added is less than 3 parts by weight, low-temperature fixability and a hot-offset resistance are not sufficiently improved. When the amount of the release agent added exceeds 10 parts by weight, dispersibility of the release agent in the kneaded material is lowered, and thus, it is impossible to stably obtain a toner having a fixed performance. Moreover, a phenomenon called filming, in which the toner is fused in a coating (film) form on the surface of an image bearing member such as a photoreceptor, is generated.

A melting point of the release agent is preferably 50° C. or higher and 180° C. or lower. When the melting point is lower than 50° C., the release agent is melted inside a developing device and toner particles are aggregated to each other or the filming on a surface of a photoreceptor or the like is generated. When the melting point exceeds 180° C., the release agent cannot sufficiently elute when the toner is fixed to a recording medium, so that the hot-offset resistance is not sufficiently improved.

(Charge Control Agent)

As the charge control agent included in the toner according to the embodiment, charge control agents for positive charge control and negative charge control which are commonly used in this field are usable.

Examples of the charge control agent for positive charge control include a basic dye, quaternary ammonium salt, quaternary phosphonium salt, aminopyrine, a pyrimidine compound, a polynuclear polyamino compound, aminosilane, a nigrosine dye and a derivative thereof, a triphenylmethane derivative, guanidine salt, and amidine salt.

Examples of the charge control agent for negative charge control include oil-soluble dyes such as oil black and spiron black, a metal-containing azo compound, an azo complex dye, metal salt of naphthene acid, metal complex and metal salt (the metal includes chrome, zinc, zirconium and the like) of salicylic acid and a derivative thereof, a boron compound, a fatty acid soap, long-chain alkylcarboxylic acid salt, and a resin acid soap. The charge control agents may be used each alone, or two or more of them may be used in combination as necessary. The amount of the charge control agent used is not particularly limited and may be selected appropriately from a wide range, and is preferably 0.01 part by weight or more and 5 parts by weight or less relative to 100 parts by weight of toner base particles.

For the mixer used at the mixing step, those which are publicly known are usable and the mixers same as those which are used for preparing the master batch are usable.

(2) Melt-Kneading Step S2

At the melt-kneading step S2, the admixture prepared at the mixing step S1 is melt-kneaded with a kneader to prepare a melt-kneaded material in which the colorant and the additive added as necessary are dispersed into the binder resin.

For the kneader used at the melt-kneading step S2, those which are publicly known are usable and the kneaders same as those which are used for preparing the master batch are usable. Melt-kneading may be performed with the use of a plurality of kneaders.

The temperature of melt-kneading depends upon the kneader that is used and is preferably 80° C. or higher and 200° C. or lower. Melt-kneading under the temperature in such a range makes it possible to uniformly disperse the colorant and the additive added as necessary into the binder resin.

(3) Cooling and Pulverizing Step S3

At the cooling and pulverizing step S3, the melt-kneaded material obtained at the melt-kneading step S2 is cooled, solidified, and pulverized to obtain a pulverized material.

The melt-kneaded material which has been cooled and solidified is coarsely pulverized into a coarsely pulverized material having a volume average particle size of 100 μm or more and 5 mm or less by a hammer mill, a cutting mill or the like, and the obtained coarsely pulverized material is further finely pulverized, for example, to have a volume average particle size of 15 μm or less. For fine pulverization of the coarsely pulverized material, for example, a jet pulverizer utilizing an ultrasonic jet stream, an impact pulverizer for achieving pulverization by introducing a coarsely pulverized material into a space to be formed between a rotator (rotor) rotating at a high speed and a stator (liner), or the like is usable.

(4) Classifying Step S4

At the classifying step S4, the pulverized material obtained at the cooling and pulverizing step S3 is classified by a classifier and an excessively-pulverized toner particle and a coarse toner particle are removed therefrom to obtain a toner having no external additives. The excessively-pulverized toner particle and the coarse toner particle can be also recovered and reused for manufacturing other toner.

For the classification, publicly known classifiers capable of removing excessively pulverized toner particles by classification with a centrifugal force and classification with a wind force are usable and, for example, a revolving type wind-force classifier (rotary type wind-force classifier) and the like are usable.

The toner having no external additives obtained after the classification preferably has a volume average particle size of 3 μm or more and 15 μm or less. For the purpose of obtaining an image with high image quality, the toner having no external additives preferably has a volume average particle size of 3 μm or more and 9 μm or less, and more preferably 5 μm or more and 8 μm or less. When the volume average particle size of the toner having no external additives is less than 3 μm, the particle size of the toner becomes small so that high electrification and low fluidization occur. With high electrification and low fluidization of the toner, the toner is not stably supplied into a photoreceptor, and thus, background fogging, a reduction of the image density, and the like are generated. When the volume average particle size of the toner having no external additives exceeds 15 μm, the particle size of the toner is too large to obtain an image with high resolution. In addition, as the particle size of the toner is large, a specific surface area is decreased, and the charge amount of the toner becomes low. As a result, the toner is not stably supplied into the photoreceptor, and thus, contamination within the machine is generated due to flying of the toner.

(5) External Addition Step S5

At the external addition step S5, the toner having no external additives obtained at the classifying step S4 and the external additive are mixed to obtain a toner. By adding the external additive, flowability of the toner and a cleaning property of the toner remaining on the surface of a photoreceptor are improved, thus making it possible to prevent the filming on the photoreceptor. It is also possible to use a toner having no external additives to which no external additives are added as the toner.

Examples of the external additive include inorganic oxides such as silica, alumina, titanic, zirconia, tin oxide, and zinc oxide; compounds such as acrylic acid esters, methacrylic acid esters, and styrene, or copolymer resin fine particles of those compounds; fluorine resin fine particles; silicone resin fine particles; higher fatty acids such as stearic acid, or metallic salts of those higher fatty acids; carbon black; graphite fluoride; silicon carbide; and boron nitride.

The external additive is preferably subjected to the surface treatment by a silicone resin, a silane coupling agent, or the like. In addition, the amount of the external additive added is preferably 0.5 part by weight or more and 5 parts by weight or less relative to 100 parts by weight of the binder resin.

A number average particle size of primary particles of the external additive is preferably 10 nm or more and 500 nm or less. When the number average particle size of primary particles of the external additive falls within such a range, flowability of the toner is further improved.

A BET specific surface area of the external additive is preferably 20 $m^2/g$ or more and 200 $m^2/g$ or less. When the BET specific surface area of the external additive falls within such a range, it is possible to impart appropriate flowability and chargeability to the toner.

2. Toner

The toner according to the embodiment is manufactured by the method for manufacturing the toner which is the aforementioned embodiment. A toner obtained by the method for manufacturing the toner is sufficient in mechanical strength, and is excellent in a hot-offset resistance and charging stability.

3. Developer

The toner according to the embodiment is usable as a one-component developer composed of a toner alone or is also usable as a two-component developer upon being mixed with a carrier.

As the carrier, those which are publicly known are usable and examples thereof include single or complex ferrite composed of iron, copper, zinc, nickel, cobalt, manganese, chromium, or the like; a resin-coated carrier having carrier core particles whose surfaces are coated with coating materials; and a resin-dispersion type carrier in which magnetic particles are dispersed in a resin.

As the coating material, those which are publicly known are usable, and examples thereof include polytetrafluoroethylene, a monochlorotrifluoroethylene polymer, polyvinylidene fluoride, a silicone resin, a polyester resin, a metal compound of di-tertiary-butylsalicylic acid, a styrene resin, an acrylic resin, polyimide, polyvinyl butyral, nigrosine, an aminoacrylate resin, basic dyes, lakes of basic dyes, fine silica powders, and fine alumina powders. In addition, the resin used for the resin-dispersion type carrier is not particularly limited, and examples thereof include a styrene-acrylic resin, a polyester resin, a fluorine resin, and a phenol resin. Both of the coating materials are preferably selected according to the toner components, and these may be used each alone, or two or more of them may be used in combination.

The carrier preferably has a spherical shape or a flattened shape. The particle size of the carrier is not particularly limited, and in consideration of forming higher-quality images, the particle size of the carrier is preferably 10 μm to 100 μm, and more preferably 20 μm or more and 50 μm or less. When the particle size of the carrier is 50 μm or less, the toner and the carrier come into contact with each other more frequently, and each toner particle can be charged and controlled properly, thereby allowing for formation of a high-quality images having no fog occurring on the non-image region.

Furthermore, volume resistivity of the carrier is preferably $10^8$ Ω·cm or more, and more preferably $10^{12}$ Ω·cm or more. The volume resistivity of the carrier is a value obtained from a current value determined as follows. The carrier particles are put into a container having a cross-sectional area of 0.50 $cm^2$, and then tapped. Subsequently, a load of 1 $kg/cm^2$ is applied by use of a weight to the particles which are held in the container. When an electric field of 1000 V/cm is generated between the weight and a bottom electrode of the container by application of voltage, a current value is read. When the resistivity of the carrier is low, an electric charge will be injected into the carrier upon application of bias voltage to a developing sleeve, thus causing the carrier particles to be more easily attached to the photoreceptor. Further, breakdown of the bias voltage is more liable to occur.

The magnetization intensity (maximum magnetization) of the carrier is preferably 10 emu/g to 60 emu/g, and more preferably 15 emu/g to 40 emu/g. Under the condition of the ordinary magnetic flux density of the developing roller, a magnetic binding force does not work magnetization intensity of less than 10 emu/g, which may cause the carrier to spatter. Further, the carrier having a magnetization intensity of more than 60 emu/g has bushes which are too large to keep the non-contact state of the image bearing member with the toner in the non-contact development and possibly causes sweeping streaks to easily appear on a toner image in the contact development.

The use ratio of the toner to the carrier in the two-component developer is not particularly limited, and is appropriately selected according to kinds of the toner and the carrier. Further, the coverage of the carrier with the toner is preferably 40% or more and 80% or less.

EXAMPLES

Hereinafter, referring to Examples and Comparative Examples, the technology will be specifically described.

In Examples and Comparative Examples, a glass transition temperature, a softening temperature, a weight average molecular weight, a number average molecular weight, and a THF insoluble component of the polyester resin; an acid value of the polyester resin and the disproportionated rosin; viscosity of the polyester resin B; a melting point of the release agent, and a volume average particle size and a coefficient of variation of the toner were measured as follows.

[Glass Transition Temperature (Tg) of Polyester Resin]

Using a differential scanning calorimeter (trade name: Diamond DSC, manufactured by PerkinElmer Japan Co., Ltd.), 0.01 g of a sample was heated at a temperature rise rate of 10° C. per minute (10° C./min) in conformity with Japan Industrial Standards (JIB) K7121-1987, thereby measuring a DSC curve. A temperature at an intersection between an extended straight line obtained by drawing a base line on a low-temperature side of an endothermic peak corresponding to glass transition of the obtained DSC curve toward a high-temperature side and a tangent line drawn at a point where a gradient became the maximum against the curve on the low-temperature side of the endothermic peak was determined as the glass transition temperature (Tg).

[Softening Temperature (Tm) of Polyester Resin]

Using a device for evaluating flow characteristics (trade name: FLOW TESTER CFT-500C, manufactured by Shimadzu Corporation), 1 g of a sample was heated at a temperature rise rate of 6° C. per minute while applying a load of 10 $kgf/cm^2$ ($9.8\times10^5$ Pa) so as to be pushed out of a die (1 mm in a nozzle aperture and 1 mm in length), and a temperature of the sample at the time when a half of the sample had flowed out of the die was determined as the softening temperature (Tm).

[Weight Average Molecular Weight (Mw) and Number Average Molecular Weight (Mn) of Polyester Resin]

A sample was dissolved in a tetrahydrofuran (THF) to be 0.25% by weight, and 200 μL of the sample was injected to a GPC device (trade name: HLC-8220GPC, manufactured by Toson Corporation) and a molecular weight distribution curve was determined at a temperature of 40° C. A weight average molecular weight Mw and a number average molecular weight Mn were determined from the obtained molecular weight distribution curve, and a molecular weight distribution index (Mw/Mn; hereinafter also referred to simply as "Mw/Mn") which is a ratio of the weight average molecular weight Mw to the number average molecular weight Mn was determined. Note that, a molecular weight calibration curve was made using standard polystyrene.

[Acid Value of Polyester Resin and Rosin]

An acid value was measured by a neutralization titration method. In 50 mL of tetrahydrofuran (THF), 5 g of a sample was dissolved, and after adding a few drops of an ethanol solution of phenolphthalein as an indicator, the solution was titrated with 0.1 mole/L of a potassium hydroxide (KOH) aqueous solution. A point at which a color of the sample solution changed from colorless to purple was defined as an end point, and an acid value (mgKOH/g) was calculated from the amount of the potassium hydroxide aqueous solution required for the arrival at the end point and a weight of the sample provided for the titration.

[THF Insoluble Component of Polyester Resin]

In cylindrical filter paper, 1 g of a sample was inputted and applied to a Soxhlet extractor. Using 100 ml of tetrahydrofuran (THF) as an extraction solvent, reflux was made for 6 hours upon heating, thereby extracting a THF soluble component from the sample. After removing the solvent from an extraction containing the extracted THF soluble component, the THF soluble component was dried at 100° C. for 24 hours, and the obtained THF soluble component was weighed to determine the weight X (g). A proportion P (% by weight) of a THF insoluble component in the sample was calculated from the weight X (g) of the THF soluble component and the weight (1 g) of the sample used for the measurement on the basis of the following expression. This proportion P is hereinafter referred to as THF insoluble component.

$$P\ (\%\ \text{by weight})=\{1\ (\text{g})-X\ (\text{g})\}/1\ (\text{g})\times 100$$

[Viscosity of Polyester Resin B]

By a tablet molding device A, 0.6 g of a sample was pressed for one minute (25° C., about 20 MPa) to obtain a sample for measurement with a thickness of 0.5 mm and a diameter of 25 mm. Thus obtained sample for measurement was sandwiched between parallel plates with a diameter of 25 mm to be heated and melted, and thereafter subjected to sine wave vibration (a space between the parallel plates of 1.0 mm, distortion of 10%, frequency of 1.0 Hz) using stress rheometer (manufactured by REOLOGICA Instruments AB), and a temperature thereof was raised from 80° C. to 200° C. at a rate of 3° C. per minute, thus measuring a viscosity η (Pa·s) at each temperature at measurement temperature intervals of 10° C. From respective obtained measurement results, a graph showing correlation between the viscosity and the temperature was created to obtain viscosity at an arbitrary temperature.

[Melting Point of Release Agent]

Using a differential scanning calorimeter (trade name: Diamond DSC, manufactured by PerkinElmer Japan Co., Ltd.), the temperature of 0.01 g of a sample was heated from 20° C. to 200° C. at a temperature rise rate of 10° C. per minute, subsequently rapidly cooled from 200° C. to 20° C., and this operation was repeated twice to measure a DSC curve. The temperature at the endothermic peak corresponding to melting of the DSC curve measured at the second operation was determined as the melting point of the release agent.

[Volume Average Particle Size and Coefficient of Variation of Toner]

To 50 ml of electrolyte (trade name: ISOTON-II, manufactured by Beckman Coulter, Inc.), 20 mg of a sample and 1 ml of sodium alkylether sulfate (dispersant, manufactured by Kishida Chemical Co., Ltd.) were added, followed by dispersion processing for 3 minutes at a frequency of 20 kHz with the use of an ultrasonic disperser (trade name: UH-50, manufactured by SMT Corporation), thereby preparing a sample for measurement.

For the sample for measurement, a particle size distribution measuring apparatus (trade name: Multisizer 3, manufactured by Beckman Coulter, Inc.) was used to perform measurement under the conditions where an aperture diameter was 20 μm and the number of particles measured was 50000 counts, thereby determining a volume average particle size from a volume particle size distribution of a sample particle. In addition, the coefficient of variation of the toner was calculated by the following expression on the basis of the volume average particle size and its standard deviation.

$$\text{Coefficient of Variation CV}\ (\%)=(\text{Standard deviation in volume particle distribution}/\text{Volume average particle size})\times 100$$

Example 1

[Preparation of Polyester Resin. A1]

In a reaction vessel equipped with an agitating device, a heating device, a thermometer, a cooling pipe, a fractionator, and a nitrogen-inducing pipe, 305 g of terephthalic acid, 55 g of isophthalic acid, 1400 g of disproportionated rosin (acid value was 157.2 mgKOH/g), and 30 g of trimellitic anhydride, which will serve as acid components; 300 g of glycerin and 150 g of 1,3-propanediol, which will serve as alcoholic components; 1.79 g of tetra-n-butyltitanate (corresponding to 0.080 part by weight relative to 100 parts by weight of the sum of acid components and alcoholic components) which will serve as reaction catalyst were inputted. These materials were agitated in a nitrogen atmosphere and subjected to the polycondensation reaction for 10 hours at 250° C. while distilling generated water, and after checking the predetermined softening temperature was reached by a flow tester, the reaction was completed, thus a polyester resin A1 (glass transition temperature of 60° C., softening temperature of 112° C., weight average molecular weight of 2800, Mw/Mn=2.3, acid value of 24 mgKOH/g, THF insoluble component of 0%) was obtained.

[Preparation of Polyester Resin B1]

In a reaction vessel equipped with an agitating device, a heating device, a thermometer, a cooling pipe, a fractional distillation device, and a nitrogen-inducing pipe, 350 g of terephthalic acid, 400 g of isophthalic acid, and 50 g of trimellitic anhydride, which will serve as acid components; 125 g of glycerin, 350 g of bisphenol A PO 2 moles adduct, and 450 g of bisphenol A PO 3 moles adduct, which will serve as alcoholic components; 1.38 g of tetra-n-butyl titanate which will server as reaction catalyst were inputted. These materials were agitated in a nitrogen atmosphere and subjected to the polycondensation reaction for 10 hours at 220° C. while distilling generated water, then, were reacted under a reduced pressure of 5 to 20 mmHg (665 to 2660 Pa), and after checking the predetermined softening temperature was reached by a flow tester, the reaction was completed, thus a polyester resin B1 (glass transition temperature of 61° C., softening temperature of 147° C., weight average molecular weight of 29500, Mw/Mn=10.8, acid value of 22 mgKOH/g, THF insoluble component of 40%) was obtained.

<Mixing Step S1>

A master batch A in which a carbon black (trade name: MA-77, manufactured by Mitsubishi Chemical Corporation) was dispersed by kneading in advance at the concentration of 11.5% by weight into the polyester resin A1 was prepared.

| | |
|---|---|
| Master batch A | 43.5 parts by weight |
| Polyester resin B1 | 52.7 parts by weight |
| Release agent (polyethylene wax, trade name: Licowax PE-130 Powder, manufactured by Clariant, melting point of 127° C.) | 2.6 parts by weight |
| Charge control agent (trade name: LR-147, manufactured by Japan Carlit Co., Ltd.) | 1.3 parts by weight |

The aforementioned materials were mixed for 10 minutes by a Henschel mixer (trade name: FM20C, manufactured by Mitsui Mining Co., Ltd.) and 50 kg c an admixture was obtained.

<Melt-Kneading Step S2>

The admixture obtained at the mixing step S1 was melt-kneaded (a cylinder setting temperature of 80° C. to 120° C., the number of rotations of 250 rpm, supplying rate of 5 kg/h)

by a kneader (trade name: twin-screw kneader PCM-60, manufactured by Ikegai Corp), thus the melt-kneaded material was obtained.

<Cooling and Pulverizing Step S3>

The melt-kneaded material obtained at the melt-kneading step S2 was cooled to a room temperature and solidified, then coarsely pulverized by a cutter mill (trade name: VM-16, manufactured by Orient Co., Ltd.). Subsequently, the coarsely pulverized material thus obtained was finely pulverized by a counter jet mill (trade name: AFG, manufactured by Hosokawa Micron Corporation).

<Classifying Step S4>

The pulverized material obtained at the cooling and pulverizing step S3 was classified by a rotary classifier (trade name: TSP separator, manufactured by Hosokawa Micron Corporation), thus a toner having no external additives was obtained.

<External Addition step S5>

To 100 parts by weight of the toner having no external additives obtained at the classifying step S4, 1.2 parts by weight of a hydrophobic silica fine particle A (surface treatment by a silane coupling agent and dimethyl silicone oil, BET specific surface area of 140 $m^2/g$), 0.8 part by weight of a hydrophobic silica fine particle B (surface treatment by a silane coupling agent, BET specific surface area of 30 $m^2/g$), and 0.5 part by weight of titanium oxide (BET specific surface area of 130 $m^2/g$) were added and mixed in a Henschel mixer (trade name: FM mixer, manufactured by Mitsui Mining Co., Ltd.), thus a toner of Example 1 (volume average particle size of 6.7 μm, CV value of 25%) was obtained.

Example 2

[Preparation of Polyester Resin A2]

A polyester resin A2 (glass transition temperature of 55° C., softening temperature of 111° C., weight average molecular weight of 2520, Mw/Mn=1.9, acid value of 11 mgKOH/g, THF insoluble component of 0%) was obtained in the same manner as Example 1, except that terephthalic acid and trimellitic anhydride were not used but 335 g of isophthalic acid and 1530 g of disproportionated rosin (acid value of 157.2 mgKOH/g) were used as acid components, and only 280 g of glycerin was used as alcoholic components.

A toner of Example 2 (volume average particle size of 6.7 μm, CV value of 25%) was obtained in the same manner as in Example 1, except that the polyester resin A2 was used instead of the polyester resin A1 at the mixing step S1.

Example 3

[Preparation of Polyester Resin A3]

A polyester resin A3 (glass transition temperature of 65° C., softening temperature of 124° C., weight average molecular weight of 5850, Mw/Mn=4.3, acid value of 10 mgKOH/g, THF insoluble component of 0%) was obtained in the same manner as Example 1, except that trimellitic anhydride was not used but 230 g of terephthalic acid, 230 g of isophthalic acid, and 1350 g of disproportionated rosin (acid value of 157.2 mgKOH/g) were used as acid components, and 330 g of glycerin and 30 g of 1,3-propanediol were used as alcoholic components.

A toner of Example 3 (volume average particle size of 6.7 μm, CV value of 24%) was obtained in the same manner as in Example 1, except that the polyester resin A3 was used instead of the polyester resin A1 at the mixing step S1.

Example 4

[Preparation of Polyester Resin B2]

A polyester resin B2 (glass transition temperature of 63° C., softening temperature of 159° C., weight average molecular weight of 48200, Mw/Mn=11.6, acid value of 18 mgKCH/g, THF insoluble component of 44%) was obtained in the same manner as Example 1, except that the reaction time was changed.

A toner of Example 4 (volume average particle size of 6.7 μm, CV value of 25%) was obtained in the same manner as Example 1, except that the polyester resin B2 was used instead of the polyester resin B1 at the mixing step S1.

Example 5

[Preparation of Polyester Resin B3]

A polyester resin B3 (glass transition temperature of 60° C., softening temperature of 135° C., weight average molecular weight of 21300, Mw/Mn=8.9, acid value of 24 mgKOH/g, THF insoluble component of 21%) was obtained in the same manner as in Example 1, except that the reaction time was changed.

A toner of Example 5 (volume average particle size of 6.7 μm, CV value of 25%) was obtained in the same manner as in Example 1, except that the polyester resin B3 was used instead of the polyester resin B1 at the mixing step S1.

Example 6

Without preparing a master batch, materials described below were mixed in the same manner as in Example 1 at the mixing step S1.

| | |
|---|---|
| Polyester resin A1 | 38.5 parts by weight |
| Carbon black (trade name: MA-77, manufactured by Mitsubishi Chemical Corporation) | 5.0 parts by weight |
| Polyester resin B1 | 52.7 parts by weight |
| Release agent (polyethylene wax, trade name: Licowax PE-130 Powder, manufactured by Clariant, melting point of 127° C.) | 2.6 parts by weight |
| Charge control agent (trade name: LR-147, manufactured by Japan Carlit Co., Ltd.) | 1.3 parts by weight |

A toner of Example 6 (volume average particle size of 6.7 μm, CV value of 25%) was obtained in the same manner as in Example 1 at the melt-kneading step S2 and subsequent steps.

Comparative Example 1

[Preparation of Polyester Resin B4]

A polyester resin B4 (glass transition temperature of 65° C., softening temperature of 165° C., weight average molecular weight of 52300, Mw/Mn=12.1, acid value of 15 mgKOH/g, THF insoluble component of 51%) was obtained in the same manner as in Example 1, except that the reaction, time was changed.

A toner of Comparative Example 1 (volume average particle size of 6.7 μm, CV value of 26%) was obtained in the same manner as in Example 1, except that the polyester resin B4 was used instead of the polyester resin B1 at the mixing step S1.

Comparative Example 2

[Preparation of Polyester Resin B5]

A polyester resin B5 (glass transition temperature of 58° C., softening temperature of 131° C., weight average molecular weight of 12500, Mw/Mn=4.3, acid value of 25 mgKOH/ g, THF insoluble component of 12%) was obtained in the same manner as in Example 1, except that the reaction time was changed.

A toner of Comparative Example 2 (volume average particle size of 6.7 μm, CV value of 26%) was obtained in the same manner as in Example 1, except that the polyester resin B5 was used instead of the polyester resin B1 at the mixing step S1.

Comparative Example 3

At the mixing step S1, a master batch B in which a carbon black (trade name: MA-77, manufactured by Mitsubishi Chemical Corporation) was dispersed by kneading in advance into the polyester resin A1 at the concentration of 7.5% by weight was prepared.

| | |
|---|---|
| Master batch B | 66.6 parts by weight |
| Polyester resin B1 | 29.5 parts by weight |
| Release agent (polyethylene wax, trade name: Licowax PE-130 Powder, manufactured by Clariant, melting point of 127° C.) | 2.6 parts by weight |
| Charge control agent (trade name: LR-147, manufactured by Japan Carlit Co., Ltd.) | 1.3 parts by weight |

A toner of Comparative Example 3 (volume average particle size of 6.7 μm, CV value of 25%) was obtained in the same manner as in Example 1 at the melt-kneading step S2 and subsequent steps, using an admixture obtained by mixing the aforementioned materials by a Henschel mixer (trade name: FM20C, manufactured by Mitsui Mining Co., Ltd.) for 10 minutes.

Comparative Example 4

At the mixing step S1, a master batch C in which a carbon black (trade name: MA-77, manufactured by Mitsubishi Chemical Corporation) was dispersed by kneading in advance into the polyester resin A1 at the concentration of 14.2% by weight was prepared.

| | |
|---|---|
| Master batch C | 35.2 parts by weight |
| Polyester resin B1 | 60.9 parts by weight |
| Release agent (polyethylene wax, trade name: Licowax PE-130 Powder, manufactured by Clariant, melting point of 127° C.) | 2.6 parts by weight |
| Charge control agent (trade name: LR-147, manufactured by Japan Carlit Co., Ltd.) | 1.3 parts by weight |

A toner of Comparative Example 4 (volume average particle size of 6.7 μm, CV value of 26%) was obtained in the same manner as in Example 1 at the melt-kneading step S2 and subsequent steps, using an admixture obtained by mixing the aforementioned materials by a Henschel mixer (trade name: FM20C, manufactured by Mitsui Mining Co., Ltd.) for 10 minutes.

For the toners obtained in Examples 1 to 6 and Comparative Examples 1 to 4, a two-component developer was prepared by mixing 5 parts by weight of each toner and 95 parts by weight of a ferrite core carrier (volume average particle size of 70 μm) for 20 minutes in a V-type mixer (trade name: V-5, manufactured by Tokuju Corporation), and evaluations were performed as follows.

<Mechanical Strength>

A color multi-functional peripheral (trade name: MX-2700, manufactured by Sharp Corporation) filled with a two-component developer including each toner was operated under the circumstance at 25° C. and 45% RH with use of recording paper (trade name: PPC paper SF-4AM3, manufactured by Sharp Corporation) as a recording medium. The volume average particle size ($D_{50}$) of the toner in the two-component developer after 20000 sheets were printed was measured and a proportion to initial $D_{50}$ (volume average particle size of toner before operation) was calculated on the basis of the following expression as particle size ratio, and the mechanical strength was evaluated by the following standards. When the toner is fragile, due to agitating in a development tank or the like, the toner is crushed and particles become small. Accordingly, the higher the particle size ratio is, the better the mechanical strength is.

$$\text{Particle size ratio (\%)} = D_{50}/(\text{Initial } D_{50}) \times 100$$

Good (Favorable): Particle size ratio is 90% or more.

Not bad (Available): Particle size ratio is 80% or more and less than 90%.

Poor (No good): Particle size ratio is less than 80%.

<Charging Stability>

In the same manner as in the evaluations of mechanical strength, the color multi-functional peripheral was operated, and a charge amount ratio of the toner in the two-component developer, an image density and a fog density were measured after an original having an image area of 5% was printed 20000 sheets.

[Charge Amount Ratio]

The measurement was made using a charge amount measuring device (trade name: 210HS-2A, manufactured by Trek Japan KK). The two-component developer was put in a metal-made container equipped with a 500-mesh conductive screen at the bottom, only the toner was sucked with a suction machine under a suction pressure of 250 mmHg (33250 Pa), and the charge amount of the toner was determined from difference between weight of the two component developer before suction and weight of the two component developer after suction, and potential difference between capacitor polar plates connected to the container. On the basis of the following expression, a proportion to the initial charge amount of the toner (charge amount of toner before operation) was calculated as a charge amount ratio, and the charge amount ratio was evaluated by the following standards.

$$\text{Charge amount ratio \%} = \{\text{Charge amount of toner } (\mu C/g)/\text{Initial charge amount of toner } (\mu C/g)\} \times 100$$

Evaluation standards of the charge amount ratio are as follows.

Good (Favorable): The charge amount ratio is 80% or more.

Not bad (Available): The charge amount ratio is 70% or more and less than 80%.

Poor (No good): The charge amount ratio is less than 70%.

[Image Density]

A solid image with 3 cm on a side was printed at 100% density, and the image density of a printed part was measured with use of a reflective densitometer (trade name: RD918, manufactured by GretagMacbeth), which was evaluated by the following standards.

Good (Favorable): The image density is 1.4 or more.

Not bad (Available): The image density is 1.2 or more and less than 1.4.

Poor (No good): The image density is less than 1.2.

[Fog Density]

Whiteness of a non-image region (0% density) was measured with use of a whiteness meter (trade name: Z-Σ90 COLOR MEASURING SYSTEM, manufactured by Nippon Denshoku Industries Co., Ltd.) to obtain difference from whiteness of before printing that has been measured in advance, which difference is served as fog density and evaluation was made based on the following standards.

Good (Favorable): The fog density is less than 0.5.

Not bad (Available): The fog density is 0.5 or more and less than 1.0.

Poor (No good): The fog density is 1.0 or more.

With use of evaluation results of the charge amount ratio, the image density and the fog density, the charging stability was evaluated based on the following standards.

Good (Favorable): Evaluation results are all rated as "Good".

Not bad (Available): At least one evaluation result is rated as "Not bad", but no evaluation results are rated as "Poor".

Poor (No good): There is an evaluation result rated as "Poor".

<Hot-Offset Resistance>

The two-component developer including each toner was filled in one remodeling a color multi-functional peripheral (trade name: MX-2700, manufactured by Sharp Corporation), thus an unfixed image was prepared. On recording paper (trade name: PPC paper SF-4AM3, manufactured by Sharp Corporation), a sample image including a rectangular-shaped solid image section of 20 mm long and 50 mm wide was adjusted so that an attachment amount of the toner to the recording paper at the solid image section was 0.5 mg/cm$^2$.

Using an external fixing device (process speed of 124 mm/sec) provided with a fixing section of the aforementioned color multi-functional peripheral, the prepared unfixed image was fixed from 130° C. in steps of 5° C., and presence or absence of offsets on test paper (A4 size, 52 g/m$^2$) was visually checked. On the basis of the hot offset initiation temperature of the toner, a hot-offset resistance was evaluated by the following standards.

Good (Favorable): Hot offset initiation temperature is 230° C. or higher.

Not bad (Available): Hot offset initiation temperature is 180° C. or higher and lower than 230° C.

Poor (No good): Hot offset initiation temperature is lower than 180° C.

<Comprehensive Evaluation>

With the evaluation results of the mechanical strength, the charging stability and the hot-offset resistance, the comprehensive evaluations were made by the following standards.

Good (Favorable): Evaluation results are all rated as "Good".

Not bad (Available): At least one evaluation result is rated as "Not bad", but no evaluation results are rated as "Poor".

Poor (No good): There is an evaluation result rated as "Poor".

Table 1 shows polyester resins used for toners of Examples 1 to 6 and Comparative examples 1 to 4, and Table 2 shows polyester resin used for each toner, and the evaluation results of each toner. The viscosity of the polyester resin B described in Table 2 is the viscosity at a softening temperature of each of the polyester resins A mixed with each of the polyester resins B.

TABLE 1

| | Polyester resin A | | | Polyester resin B | | | | |
|---|---|---|---|---|---|---|---|---|
| | A1 | A2 | A3 | B1 | B2 | B3 | B4 | B5 |
| Terephthalic acid (g) | 305 | 0 | 230 | 350 | 350 | 350 | 350 | 350 |
| Isophthalic acid (g) | 55 | 335 | 230 | 400 | 400 | 400 | 400 | 400 |
| Disproportionated rosin (g) | 1400 | 1530 | 1350 | 0 | 0 | 0 | 0 | 0 |
| Trimellitic anhydride (g) | 30 | 0 | 0 | 50 | 50 | 50 | 50 | 50 |
| Glycerine (g) | 300 | 280 | 330 | 125 | 125 | 125 | 125 | 125 |
| 1,3-propanediol (g) | 150 | 0 | 30 | 0 | 0 | 0 | 0 | 0 |
| Bisphenol A (PO 2 moles adduct) (g) | 0 | 0 | 0 | 350 | 350 | 350 | 350 | 350 |
| Bisphenol A (PO 3 moles adduct) (g) | 0 | 0 | 0 | 450 | 450 | 450 | 450 | 450 |
| Rosin content (% by weight) | 62.5 | 71.3 | 62.2 | 0.0 | 0.0 | 0.0 | 0.0 | 0.0 |
| Glass transition temperature (° C.) | 60 | 55 | 65 | 61 | 63 | 60 | 65 | 58 |
| Softening temperature (° C.) | 112 | 111 | 124 | 147 | 159 | 135 | 165 | 131 |
| Weight average molecular weight (Mw) | 2800 | 2520 | 5850 | 29500 | 48200 | 21300 | 52300 | 12500 |
| Mw/Mn | 2.3 | 1.9 | 4.3 | 10.8 | 11.6 | 8.9 | 12.1 | 4.3 |
| Acid value (mgKOH/g) | 24 | 11 | 10 | 22 | 18 | 24 | 15 | 25 |
| THF insoluble component (% by weight) | 0 | 0 | 0 | 40 | 44 | 21 | 51 | 12 |

TABLE 2

| | Polyester resin | | | Mechanical strength | |
|---|---|---|---|---|---|
| | | | Polyester resin B | | |
| | A | B (Viscosity, Pa · s) | added amount (part by weight) | Particle size ratio [%] | Evaluation |
| Example 1 | A1 | B1 ($7.30 \times 10^3$) | 137 | 95 | Good |
| Example 2 | A2 | B1 ($8.20 \times 10^3$) | 137 | 95 | Good |
| Example 3 | A3 | B1 ($3.25 \times 10^3$) | 137 | 88 | Not bad |

TABLE 2-continued

| | | | | | |
|---|---|---|---|---|---|
| Example 4 | A1 | B2 ($9.55 \times 10^4$) | 137 | 97 | Good |
| Example 5 | A1 | B3 ($1.05 \times 10^3$) | 137 | 86 | Not bad |
| Example 6 | A1 | B1 ($7.30 \times 10^3$) | 137 | 88 | Not bad |
| Comparative Example 1 | A1 | B4 ($1.13 \times 10^5$) | 137 | 88 | Not bad |
| Comparative Example 2 | A1 | B5 ($8.93 \times 10^2$) | 137 | 77 | Poor |
| Comparative Example 3 | A1 | B1 ($7.30 \times 10^3$) | 48 | 78 | Poor |
| Comparative Example 4 | A1 | B1 ($7.30 \times 10^3$) | 202 | 88 | Not bad |

| | Charging stability | | | | | | | Hot-offset resistance | | |
|---|---|---|---|---|---|---|---|---|---|---|
| | Charge amount ratio [%] | Evaluation | Image density | Evaluation | Fog density | Evaluation | Comprehensive evaluation | Hot-offset initiation temperature [° C.] | Evaluation | Comprehensive evaluation |
| Example 1 | 83 | Good | 1.5 | Good | 0.4 | Good | Good | 250 | Good | Good |
| Example 2 | 84 | Good | 1.5 | Good | 0.4 | Good | Good | 250 | Good | Good |
| Example 3 | 77 | Not bad | 1.3 | Not bad | 0.7 | Not bad | Not bad | 220 | Not bad | Not bad |
| Example 4 | 78 | Not bad | 1.3 | Not bad | 0.5 | Not bad | Not bad | 240 | Good | Not bad |
| Example 5 | 76 | Not bad | 1.3 | Not bad | 0.8 | Not bad | Not bad | 220 | Not bad | Not bad |
| Example 6 | 77 | Not bad | 1.3 | Not bad | 0.9 | Not bad | Not bad | 230 | Good | Not bad |
| Comparative Example 1 | 78 | Not bad | 1.2 | Not bad | 1.1 | Poor | Poor | 240 | Good | Poor |
| Comparative Example 2 | 66 | Poor | 1.3 | Not bad | 1.2 | Poor | Poor | 170 | Poor | Poor |
| Comparative Example 3 | 67 | Poor | 1.3 | Not bad | 1.3 | Poor | Poor | 170 | Poor | Poor |
| Comparative Example 4 | 77 | Not bad | 1.2 | Not bad | 1.3 | Poor | Poor | 230 | Good | Poor |

The results of Table 2 shows that toners of Examples 1 to 6 are excellent in mechanical strength and a hot-offset resistance, and have a stable charge amount, so that an image which has stable image density and fog density can be formed, compared to the toners of Comparative examples 1 to 4.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner comprising:

a binder resin containing a polyester resin A obtained by subjecting aromatic dicarboxylic acid, rosin, and trivalent or higher-valent alcohol as starting materials to polycondensation, a content of the rosin in a sum of starting materials being 60% by weight or more, and a polyester resin B obtained by subjecting aromatic dicarboxylic acid and polyhydric alcohol as starting materials to polycondensation, the polyester resin B having a viscosity of $7.30\times10^3$ Pa·s or more and $8.20\times10^3$ Pa·s or less at a softening temperature of the polyester resin A, the polyester resin B being contained in an amount of 50 parts by weight or more and 200 parts by weight or less relative to 100 parts by weight of the polyester resin A;

and a colorant, wherein the toner is obtained by mixing a master batch and the polyester resin B, the master batch containing the polyester resin A and the colorant.

2. A method for manufacturing a toner, comprising: a mixing step of preparing an admixture by mixing a binder resin and a colorant, the binder resin containing a polyester resin A obtained by subjecting aromatic dicarboxylic acid, rosin, and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation, the polyester resin B having a viscosity of $7.30\times10^3$ Pa·s or more and $8.20\times10^3$ Pa·s or less at a softening temperature of the polyester resin A, the polyester resin B being contained in an amount of 50 parts by weight or more and 200 parts by weight or less relative to 100 parts by weight of the polyester resin A, said mixing further comprising preparing a master batch by mixing and kneading the polyester resin A and the colorant, and preparing the admixture by mixing the polyester resin B and the master batch;

a melt-kneading step of melt-kneading the admixture to prepare a kneaded material;

a cooling and pulverizing step of cooling, solidifying and pulverizing the kneaded material to prepare a pulverized material; and a classifying step of classifying the pulverized material.

* * * * *